US008366015B2

(12) United States Patent
Van Belkom

(10) Patent No.: US 8,366,015 B2
(45) Date of Patent: Feb. 5, 2013

(54) RAILROAD TIE AND METHOD FOR BUILDING OR ADAPTING A RAILROAD

(75) Inventor: Arnoldus Van Belkom, Spannum (NL)

(73) Assignee: Lankhorst Recycling Products B.V., Sneek (NL)

( * ) Notice: Subject to any disclaimer, the term of this patent is extended or adjusted under 35 U.S.C. 154(b) by 122 days.

(21) Appl. No.: 12/445,498

(22) PCT Filed: Oct. 15, 2007

(86) PCT No.: PCT/NL2007/050496
§ 371 (c)(1),
(2), (4) Date: Aug. 28, 2009

(87) PCT Pub. No.: WO2008/048095
PCT Pub. Date: Apr. 24, 2008

(65) Prior Publication Data

US 2010/0037795 A1 Feb. 18, 2010

(30) Foreign Application Priority Data

Oct. 16, 2006 (NL) ..... 1032687

(51) Int. Cl.
*E01B 9/14* (2006.01)

(52) U.S. Cl. ..... 238/83; 238/84; 238/85; 238/91

(58) Field of Classification Search ..... 238/83–87, 238/91, 92, 94
See application file for complete search history.

(56) References Cited

U.S. PATENT DOCUMENTS

| | | | | |
|---|---|---|---|---|
| 1,192,739 | A * | 7/1916 | Blair | 238/91 |
| 3,289,940 | A * | 12/1966 | Groff | 238/29 |
| 3,416,727 | A * | 12/1968 | Collins | 238/84 |
| 3,598,312 | A * | 8/1971 | Hamilton, Jr. | 238/9 |
| 4,034,913 | A * | 7/1977 | Hooper | 238/98 |
| 4,083,491 | A * | 4/1978 | Hill | 238/98 |
| 4,108,377 | A * | 8/1978 | Potter | 238/91 |
| 4,150,790 | A * | 4/1979 | Potter | 238/83 |
| 5,799,870 | A * | 9/1998 | Bayer | 238/84 |
| 6,021,958 | A * | 2/2000 | Smith | 238/83 |
| 6,336,265 | B1 * | 1/2002 | Niedermair | 29/460 |
| 6,708,896 | B2 * | 3/2004 | Robinson | 238/84 |

(Continued)

FOREIGN PATENT DOCUMENTS

| | | |
|---|---|---|
| DE | 705655 C | 5/1941 |
| FR | 517319 A | 2/1921 |

(Continued)

OTHER PUBLICATIONS

Database WPI Week 200521, Derwent Publications Ltd., London, GB; AN 2005-199996; XP002465335 & JP 2005 054469 A (Sekisui Chem Ind Co Ltd); Mar. 3, 2005; Abstract.

(Continued)

*Primary Examiner* — S. Joseph Morano
*Assistant Examiner* — Jason C. Smith
(74) *Attorney, Agent, or Firm* — Pearne & Gordon LLP

(57) ABSTRACT

The invention relates to a railroad tie manufactured from plastic (2), wherein at least two steel bars (3) are embedded in the plastic and wherein the steel bars extend in longitudinal direction of the plastic railroad tie (1) and wherein specimens of the bars (3) situated in operative condition at different heights in the railroad tie are free from mutual connections other than by the plastic. The plastic (2) is Low Density Polyethylene.

19 Claims, 6 Drawing Sheets

U.S. PATENT DOCUMENTS

| | | | | |
|---|---|---|---|---|
| 7,204,430 | B2 * | 4/2007 | Barmakian et al. | 238/29 |
| 7,314,182 | B2 * | 1/2008 | Little et al. | 238/101 |
| 7,866,569 | B2 * | 1/2011 | Cadwell | 238/83 |
| 2006/0180046 | A1 * | 8/2006 | Barmakian et al. | 104/124 |
| 2007/0186801 | A1 * | 8/2007 | Barmakian et al. | 104/124 |
| 2010/0037795 | A1 * | 2/2010 | Van Belkom | 104/9 |
| 2010/0170956 | A1 * | 7/2010 | Cadwell | 238/85 |

FOREIGN PATENT DOCUMENTS

| | | | |
|---|---|---|---|
| GB | 536121 | A | 5/1941 |
| JP | 2005054469 | A | 3/2005 |
| WO | 2005013669 | A2 | 2/2005 |
| WO | 2005100691 | A | 10/2005 |
| WO | 2006088857 | A | 8/2006 |
| ZA | 9303262 | A | 2/1994 |

OTHER PUBLICATIONS

Database WPI Week 199418, Derwent Publications Ltd., London, GB; AN 1994-151673; XP002422328 & ZA 9 303 262 A (Brasher G M); Feb. 23, 1994; Abstract.

* cited by examiner 1
2
3
3

1
2
3
3
3
3
1

1
2
3
3
3
3
I
I
II
II

RAILROAD TIE AND METHOD FOR BUILDING OR ADAPTING A RAILROAD

The invention relates to a railroad tie manufactured from plastic, and to a method for building or adapting a railroad.

Railroad tracks (rails) of a railroad must be firmly and evenly supported. Due to railroad carriages driving over the rails, great forces occur. It is of importance that these forces are damped. When supporting the rails, it is further of importance that the mutual, lateral distance between the rails remains as constant as possible. Railroads cover very long stretches, over various soils, bridges and the like, and comprise different sorts of railroad switches. The support must therefore not only be reliable and sound, but also widely applicable, inexpensive to provide or to adapt, durable and maintenance-free.

An important element in the support of rails is a railroad tie. The railroad tie supports the rails, while the tie is placed with its longitudinal direction transversely to the rails attached to the railroad tie. Via the railroad tie, the forces exerted by railroad carriages on the rails are transmitted to the underground, while the railroad tie, also because it being placed transversely to the rails, must also ensure that the mutual, lateral distance between the rails remains as good as possible.

Of old, railroad ties are made of wood. Drawbacks inherent to this are that many kinds of wood have short lifespan of, at most, 10 to 15 years and that preserved wood is a burden to the environment. Creosoting railroad ties for instance has meanwhile been banned in the Netherlands on the basis of the Pesticides Act. Further, tropical hardwood is hard to come by in the large sizes required for railroad ties.

Railroad ties are also manufactured from concrete, so that the above-mentioned problems regarding wood are avoided. However, a drawback of a concrete railroad tie is that in a number of situations, it can be applied less well or not at all. The fact is that a concrete railroad tie has a poorer damping than a wooden railroad tie. A concrete railroad tie therefore requires a thicker gravel bed under the railroad tie than a wooden railroad tie. This has as a result that concrete railroad ties cannot be used straightaway for replacing written-off wooden railroad ties in an existing railroad, as the gravel bed under the existing railroad is too thin. On a railroad bridge too, where no gravel is used, a concrete railroad tie can be applied less well.

Another drawback of concrete railroad ties is that is it relatively laborious and expensive to use concrete railroad ties in a railroad switch. A railroad switch requires a large number of mutually different railroad ties. For instance, for one switch more than fifty railroad ties may be required, with some mutually differing in height. Further, various types of railroad switches exist. For a railroad switch, the way the switch is built up must be highly accurately measured out and the ties must be very accurately poured to size in concrete, with poured-in attachment elements for attaching the rails to the railroad ties. Such drawbacks occur to a lesser extent with wooden ties, as in a wooden railroad tie, drilling can be done in situ.

Further, ties are also manufactured from plastic, which avoids not only the drawbacks regarding wood, but also those of concrete. With plastic for instance, a better damping can be obtained than with concrete, while furthermore, in plastic, drilling can take place.

However, a drawback of the known plastic railroad tie is that in case of temperature differences, such as day/night differences or summer/winter differences, it expands and/or shrinks relatively strongly in its longitudinal direction. This gives a relatively large variation in the track width of the rails provided on the plastic railroad ties. This is undesired for, inter alia, the following reasons. In use, at their insides, railroad tracks should only wear away to a limited extent. If, as a result of such wear, the mutual, lateral distance between the rails exceeds a maximum allowable upper limit, maintenance must be carried out on the rails. The relatively strong expansion behaviour of the plastic railroad ties in itself causes the upper limit of this distance to be fairly rapidly reached. Furthermore, the relatively strong shrinkage behaviour of plastic railroad ties can effect more rapid wear of the inside of the rails, which further adversely affects the speed at which the upper limit mentioned is reached. All this therefore leads to the necessity of more frequent maintenance to the rails when the known plastic railroad ties are used. Further, in use, the relatively strong shrinkage behaviour of plastic railroad ties can cause more rapid wear of the wheels of railroad carriages.

It is also known to use plastic railroad ties filled with glass fiber (mats). Use of glass fiber can reduce the expansion and shrinkage behaviour of the railroad ties. However, in order to obtain an allowable expansion and shrinkage behaviour, relatively much glass fiber is to be utilized in a plastic railroad tie. This not only adversely affects the cost price of the railroad tie, but also the damping properties and the susceptibility to breakage of the railroad tie.

Further, from U.S. Pat. No. 6,021,958A, a plastic railroad tie is known provided with metal reinforcement bars. However, U.S. Pat. No. 6,021,958A shows no example of a specific plastic material. With this known reinforced railroad tie, the linear expansion coefficient of the metal reinforcement bars is, in general, many times smaller than the linear expansion coefficient of the plastic of the railroad tie. In the event of temperature differences, such as day/night differences or summer/winter differences, in general, due to the imposed deformations resulting from these differences in expansion coefficient, the plastic will start to tear. This is at the expense of the reliability and the soundness of this known railroad tie. U.S. Pat. No. 6,021,958A shows neither this problem nor a solution to this problem.

Further, from WO2006088857A, a plastic railroad tie is known provided with a larger metal reinforcing structure, A drawback of the railroad tie known from WO200608857 is that the use of the larger metal reinforcing structure results in poor damping properties of the railroad tie. With this railroad tie known from WO2006088857, the problem of tearing of the plastic occurs too, as explained hereinabove with reference to the railroad-tie known from U.S. Pat. No. 6,021,958A.

It is an object of the invention to provide an efficient and widely applicable solution according to which rails of a railroad are reliably and soundly supported.

To that end, according to the invention, a railroad tie is provided which is manufactured from Low Density Polyethylene (LDPE), and wherein at least two steel bars are embedded in the LDPE, the steels bars extending in longitudinal direction of the railroad tie, while specimen of the bars situated in operative condition at different heights in the railroad tie are free from mutual connections other than by the LDPE. Also according to the invention, a method for building or adapting a railroad is characterized in that such a railroad tie is utilized in the railroad.

LDPE is a thermoplastic plastic with a very low rigidity. As an important requirement for a railroad tie is that the railroad tie has a high flexural rigidity, designing a railroad tie in the LDPE material has never been considered because of the fact that the rigidity of LDPE is very low. For a railroad tie manufactured from plastic, with steel bars embedded in the plastic and, wherein the steel bars extend in longitudinal direction of the plastic railroad tie, and wherein specimen of the bars situated in operative condition at different heights in the railroad tie are free from mutual connections other than by the plastic, the plastic acts as connecting element between the steel bars and the plastic, and the plastic therefore also plays a part in the creation of rigidity of the railroad tie. Therefore, for such a railroad tie provided with steel bars too, it has never been considered to design this in LDPE.

Surprisingly however, it has appeared that designing a railroad tie provided with such steels bars in the material LDPE leads to a flexural rigidity of the railroad tie that is acceptable in practice.

Further, LDPE can absorb a high stretch without plastically deforming or tearing. LDPE stretches along with the steel bars and has a good adhesion to the steel bars.

As the steel bars are embedded in the LDPE and extend in longitudinal direction of the railroad tie, the expansion and shrinkage of the tie in the longitudinal direction of the railroad tie is substantially determined by the linear expansion coefficient of the steel bars, which expansion coefficient is many times smaller than the linear expansion coefficient of the LDPE of the railroad tie. In this way, the degree of expansion and shrinkage of the railroad tie according to the invention is at a good level, comparable to that of a concrete railroad tie.

The railroad tie according to the invention further has excellent damping properties, better even than the softest types of wood, because they are defined by the LDPE which has a very low rigidity. As a result of the embedded steel bars, the flexural strength and rigidity of the railroad tie according to the invention are at an acceptable level too, i.e. comparable to that of a hardwood railroad tie.

Further, in terms of cost price, LDPE is a favourable solution for railroad ties, as much material is used in a railroad tie and railroad ties are applied in very great numbers in railroads.

Further, when building or adapting a railroad, just as, or even better than with wooden railroad ties, drilling can be carried out in the LDPE railroad ties.

Specific embodiments of the invention are laid down in the dependent claims.

In the following, the invention is explained in further detail with reference to the schematic Figures in the appended drawing.

Figures 1, 2, 3:
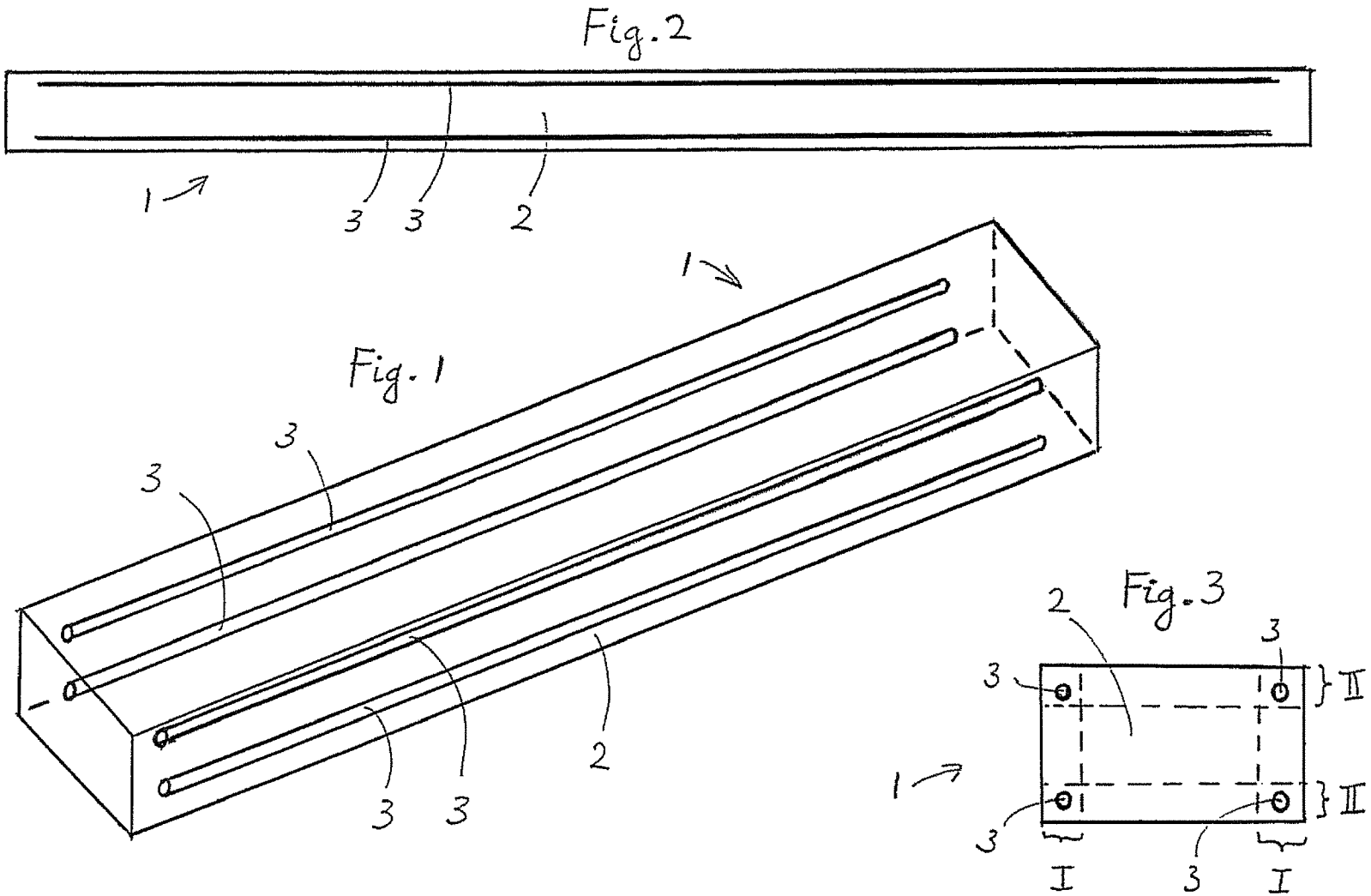
FIG. 1 shows, in perspective, an example of an embodiment of a railroad tie according to the invention.
FIG. 2 shows a longitudinal cross section of the railroad tie shown in FIG. 1.
FIG. 3 shows a cross section of the railroad tie shown in FIG. 1.

First, reference is made to the example of FIGS. 1-3.

In FIGS. 1-3, a tie 1 is shown, manufactured from LDPE 2. In the example shown, the railroad tie 1 comprises four steel bars 3 embedded in the LDPE 2 and extending in longitudinal direction of the railroad tie. Instead of a number of four steel bars, a railroad tie according to the invention can also comprise a different number, at least two, of such bars 3.

In the example shown, the bars 3 are free from mutual connections other than by the LDPE. More particularly, specimens of bars 3 situated, in operative condition, at different heights in the railroad tie are free from mutual connections other than by the LDPE.

The rigidity of LDPE is such that in this manner, the railroad tie 1 has good internal damping properties, so that the railroad tie properly damps the forces exerted on the rails by railroad carriages driving over them. The steel bars 3 ensure that the railroad tie 1, considered as a whole object, has a good flexural strength and rigidity for absorbing the forces exerted by the railroad carriages and for transmitting them to the underground. Furthermore, LDPE is a material without additives or auxiliary substances, so that in use, there is no risk of substances leaching from the railroad tie into the underground. Further, the high electric resistance of LDPE is advantageous for providing the railroad tie with a suitable electric resistance. The electric resistance of railroad ties is of importance when, by means of low voltage on the rails, signals are produced for the purpose of, for instance, determining the position of a railroad carriage driving over the railroad.

It is preferred that at least one of the at least two bars 3 extends in a first zone I of the railroad tie, which first zone is located, in operative condition, between a longitudinal side of the railroad tie 1 and a sectional plane through the railroad tie, located at a first distance from the longitudinal side, and at least one other of the at least two bars extends in a similar first zone I, located opposite the first zone on the opposite longitudinal side, while the first distance is less than 25%, more preferably less than 15% of the width of the railroad tie. An advantage of the location of the bars 3 in the first zone(s) I is, that in zones of the railroad tie located outside the first zone(s) I, drilling can take place without a steel bar 3 being hit. This zone I is suitable for, for instance, attaching so-called tie plates by means of screws to the railroad tie 1, via which tie plates rails can be attached to the railroad tie 1.

Further, preferably at least one of the at least two bars 3 extends in a second zone II of the railroad tie, which second zone is located, in operative condition, between a top, or bottom of the railroad tie and a sectional plane through the railroad tie, located at a second distance from the top, or bottom, and at least one other of the at least two bars extends in a similar second zone (II) located opposite the second zone at the opposite top, or bottom, while the second distance is less than 25%, more preferably less than 15%, of the width of the railroad tie. An advantage of the location of the bars 3 in the second zone(s) II is that the tie has the greatest local flexural strength and rigidity in precisely those zones that are important for absorbing forces from rails attached to the railroad tie and/or for transmitting such forces to the underground of the railroad tie.

In the example shown, the four respective bars 3 are located in four different areas, respectively, each of which being an overlapping area of one of the first zones I and one of the second zones II. In the example shown, for instance, the railroad tie width can be 250 mm and the railroad tie height 150 mm, while the bars each have a diameter of 16 mm and are each situated with their central axis at a distance of 20 mm from a longitudinal side of the railroad tie, and at 20 mm from a top, or bottom of the railroad tie.

The tie can comprise one or more recesses for receiving the attachment means for attaching rails to the railroad tie. Such recesses (not shown in the Figures) can for instance be recesses for receiving the above-mentioned tie plates. This simplifies the provision of such attachment means and improves the fixation of the attachment means with respect to the railroad tie.

The steel bars 3 can further have non-smooth surfaces. This offers the advantage of an improved transmission of forces between the LDPE 2 and the bars 3. This improved force transmission is favourable for absorbing external loads which can operatively act on the railroad ties. But this improved force transmission also provides a further improvement of the extent of expansion and shrinkage of the railroad tie resulting from temperature changes. Examples of advantageous non-smooth surfaces of the bars are profiled surfaces, roughened surfaces or surfaces provided with granular material. Profiled surfaces can be provided with, for instance, ribs, grooves or other types of elevations and depressions. Roughened surfaces can for instance be sanded surfaces or surfaces brushed with (wire) brushes.

The steel bars can further be embedded in the railroad tie such that ends of the steel bars are in the railroad tie at a distance from ends of the railroad tie. This is shown in FIG. 1 and FIG. 2. As a result, the bars 3 are not exposed at the ends of the railroad tie, so that corrosion is prevented.

According to a method for building or adapting a railroad, the above-described railroad ties 1 can be used in the railroad. When building or adapting the railroad, in situ drilling in the railroad tie can take place for attaching rails to the railroad ties.

An existing railroad tie present in the railroad can for instance be replaced by the railroad tie 1. In this manner, the railroad can comprise wooden railroad ties which, as the wooden ties have good damping properties, have been placed on a relatively thin gravel bed. If one or several of these wooden railroad ties are affected by decay, they must be replaced. Replacement by new wooden railroad ties leads to the drawbacks mentioned in the introductory description for wooden railroad ties. Replacement by concrete railroad ties presents the drawback that, due to the poor damping properties of concrete, use of concrete railroad ties requires a thicker gravel bed than the thin gravel bed present. In such a situation, replacement by the described LDPE railroad ties with embedded bars offers relief.

When building or adapting a railroad on a railway bridge too, where no gravel bed is utilized, the LDPE ties with embedded bars bring relief.

The above-mentioned, described LDPE ties with embedded bars can further be utilized in a railroad switch. It is advantageous when building a new railroad switch as well as when replacing one or more existing railroad ties in an existing railroad switch, that drilling can take place in situ in the LDPE ties with embedded bars. The shortcomings already described in the introduction that are attached to the use of concrete ties in a railroad switch are thus for the greater part avoided.

Manufacture of a railroad tie according to the invention can take place by means of extrusion, but also through, for instance, injection molding. An advantage of injection molding in a mold is that this offers more choice with respect to the design of the railroad tie. Injection molding is also a suitable process through which the railroad tie can be manufactured such that the steel bars are in the railroad tie at a distance from ends of the railroad tie.

Some examples of railroad ties according to the invention that can be manufactured by means of injection molding are elucidated in the following with reference to FIGS. 4-8. In FIGS. 4-8, reference numeral 2 indicates the LDPE, reference numeral 3 a steel bar and reference numeral 4 a tie plate attached to the respective railroad tie by means of screws. By means of such tie plates, rails can be attached to the respective railroad tie.

Figures 4A, 4B:
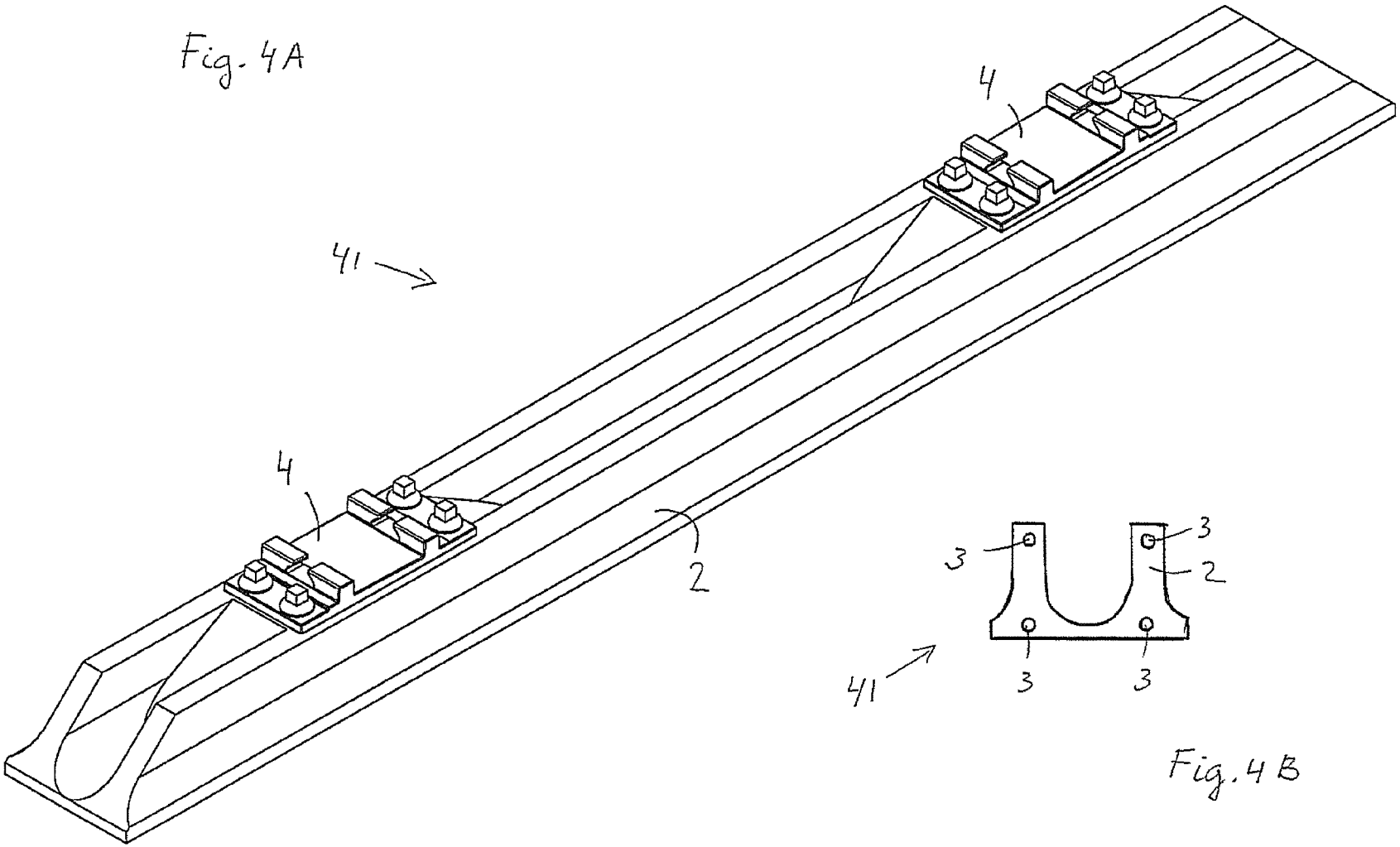
FIG. 4A shows, in perspective, an example of another embodiment of a railroad tie according to the invention.
FIG. 4B shows a cross section of the railroad tie shown in FIG. 4A at the location of the center of the length of the railroad tie.

FIGS. 4*a* and 4B show an example of a railroad tie 41, wherein, in the operative condition, a top side of the railroad tie comprises at least one depressed top area that is depressed with respect to two spaced apart rail attachment areas of this top side. In the example shown, the rail attachment areas are the areas of this top side on which the two tie plates 4 are located. Under these rail attachment areas, there where the top side of the railroad tie 41 is, therefore, not depressed, there is relatively much LDPE. With this, in operative condition, a favourable pressure distribution from the rails to the underground is obtained. The other parts of the railroad tie 41, among which the connection between the two parts of the railroad tie 41 located under the rail attachment areas, are designed with relatively little material as a result of the depressed nature of their top sides. In this manner, an interesting savings on material is realized, which is beneficial to the cost price of the railroad tie. The primary task of the connection mentioned is to keep the rails properly spaced and give flexural rigidity to the railroad tie 41. Consequently, to this end, this portion is steel reinforced (see FIG. 4B) but further comprises little LDPE. At its underside, the railroad tie 41 widens for realizing a more favourable distribution of forces towards the underground. It is further advantageous that, in the operative condition, the depressed top areas of the railroad tie 41 can be filled in with, for instance, gravel. This gravel forms ballast for the railroad tie, which is beneficial to the stability of the railroad.

Figures 5A, 5B:
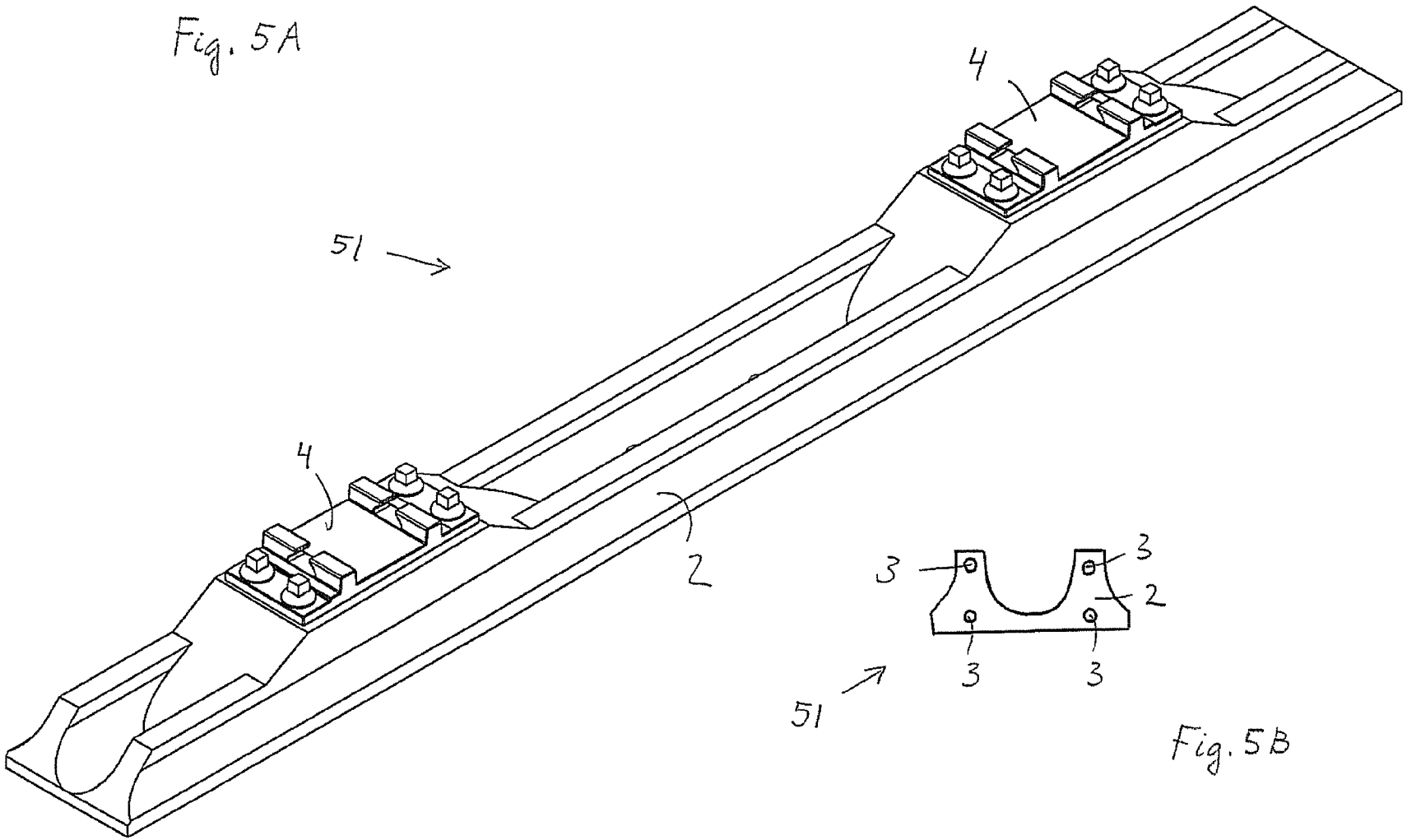
FIG. 5A shows, in perspective, an example of yet another embodiment of a railroad tie according to the invention.
FIG. 5B shows a cross section of the railroad tie shown in FIG. 5A at the location of the center of the length of the railroad tie.

In a further preferred embodiment, the entire portion of the top side of the railroad tie located outside the two rail attachment areas is depressed with respect to the rail attachment areas. An example of this is shown in FIGS. 5A and 5B, where such a railroad tie 51 is shown. With the railroad tie 41, only the rail attachment areas where the tie plates for the rails are mounted on are elevated, the rest of the railroad tie is lower. This offers the possibility to cover the entire railroad tie with a layer of gravel, so that, as it were, a fire resistant mat is obtained. This is advantageous in particular when the railroad tie is used in a tunnel, as more stringent fire safety regulations apply in tunnels. The fact is that the alternative in the form of a fire resistant concrete railroad tie for a tunnel has the drawback that it provides a poor damping. As a result, when using concrete railroad ties, a thicker gravel bed is to be utilized so that the tunnel to be dug must be greater. This is an expensive affair. Other damping increasing features with concrete railroad ties in tunnels also lead to highly increased costs.

Figures 6A, 6B:
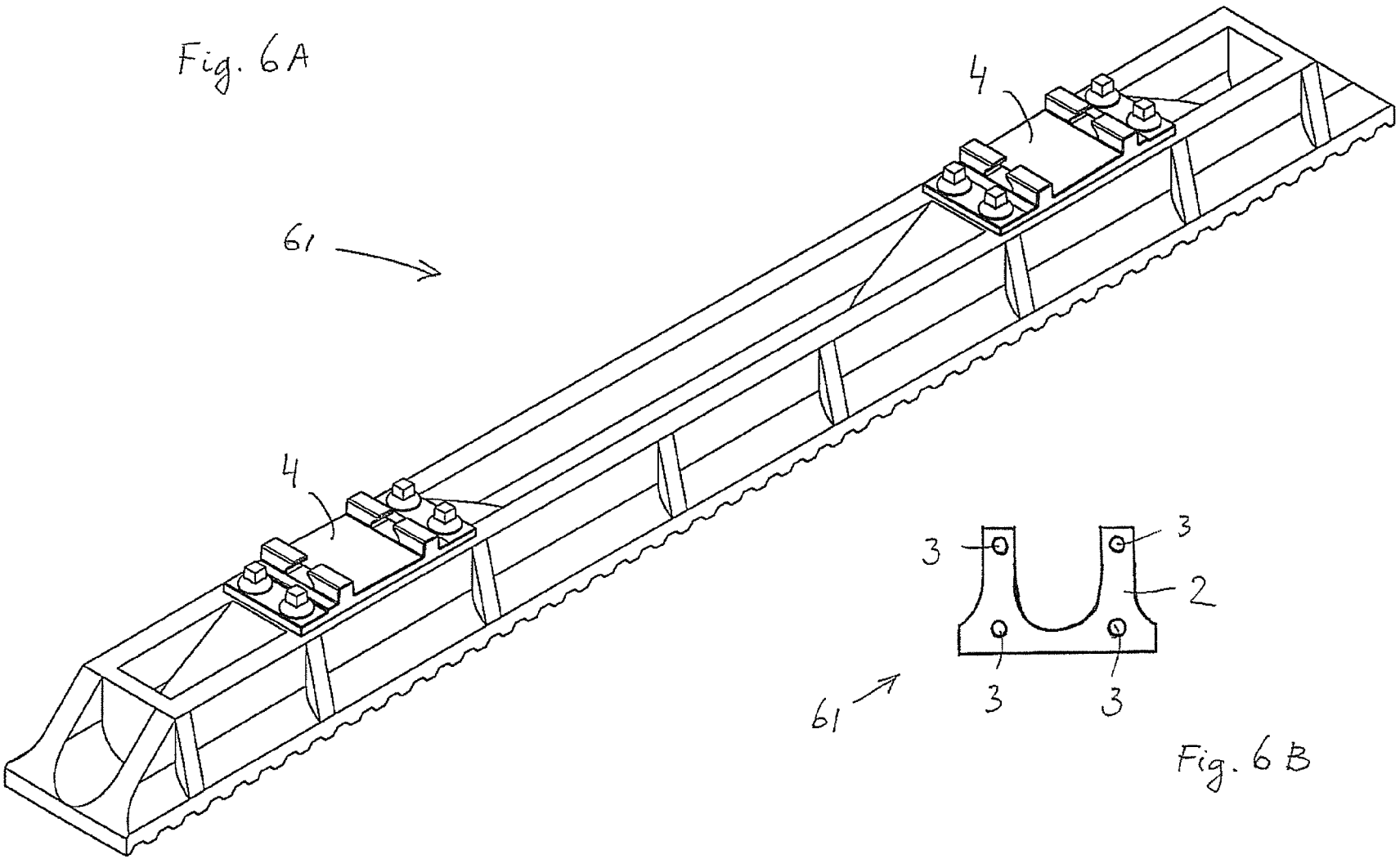
FIG. 6A shows, in perspective, an example of yet another embodiment of a railroad tie according to the invention.
FIG. 6B shows a cross section of the railroad tie shown in FIG. 6A at the location of the center of the length of the railroad tie.

In FIGS. 6A and 6B, an example is shown of a tie 61, while in operative condition, an underside and/or sides of the railroad ties are profiled. This increases the stability in the railroad tie with respect to a gravel bed or other underground. In the example shown, both the underside and the sides of the railroad tie are profiled.

Figures 7A, 7B:
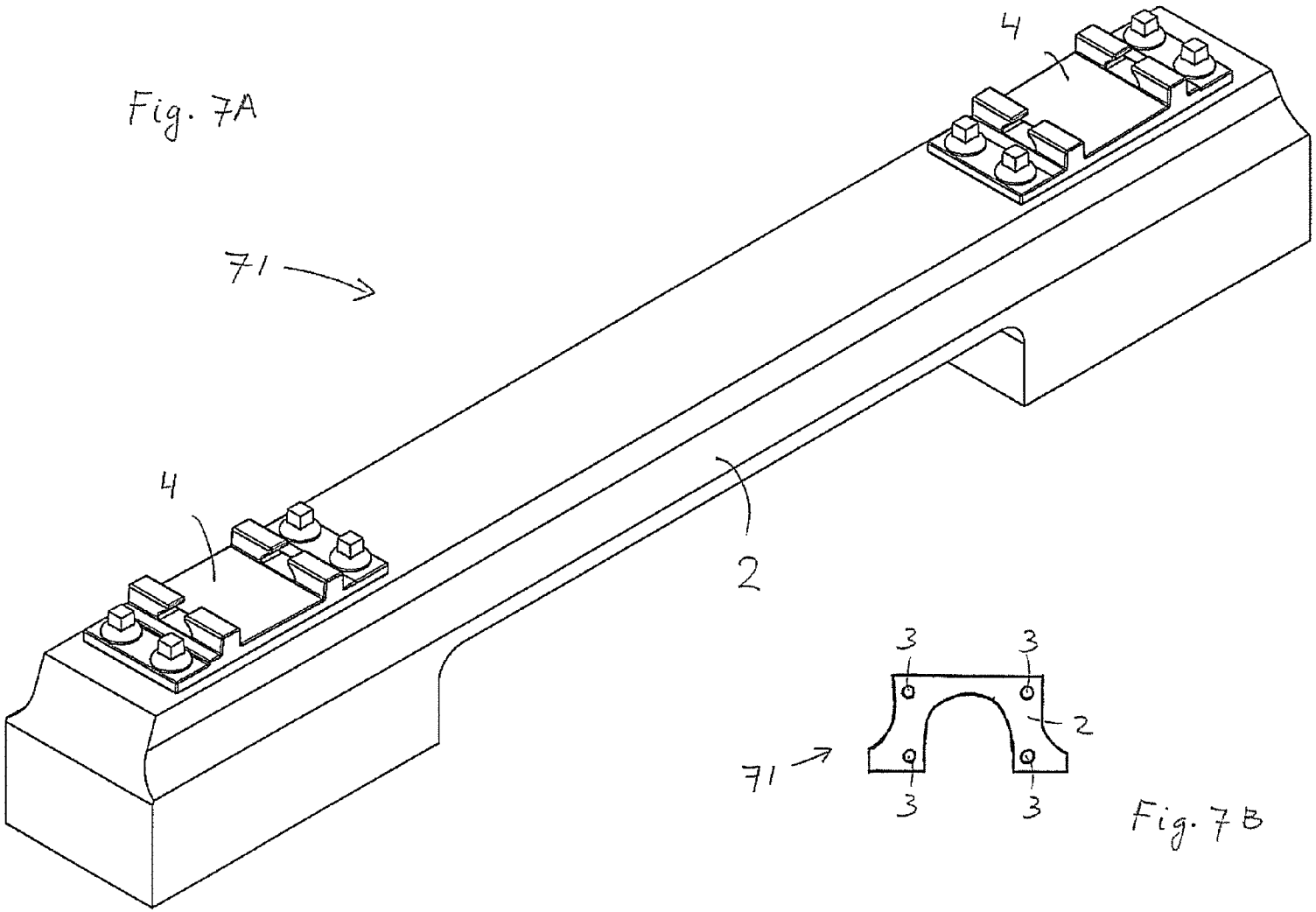
FIG. 7A shows, in perspective, an example of yet a further embodiment of a railroad tie according to the invention.
FIG. 7B shows a cross section of the tie shown in FIG. 7A at the location of the center of the length of the railroad tie.

In FIGS. 7A and 7B, an example of a railroad tie 71 is shown, wherein, in two spaced apart respective rail supporting longitudinal segments in the longitudinal direction of the railroad tie, the railroad tie has a greater height than in other longitudinal segments in the longitudinal direction of the railroad tie located outside the rail supporting longitudinal segments, in a manner such that an underside of the railroad tie, in operative condition, in the longitudinal direction of these two respective rail supporting longitudinal segments, is located lower than in the longitudinal direction of the other longitudinal segments. The railroad tie 71 shown has two solid ends with a reduced connecting part therebetween. Such a railroad tie can be advantageously used on, for instance, a steel bridge, where steel bridge ties lie under the rails. For a railroad tie for such a bridge, less stringent regulations apply with respect to the flexural rigidity. Therefore, the railroad tie 71 can have the relatively slim connecting part shown. Owing to this slim connecting part, two railroad tie ends are formed which, at the underside, can be leveled to size in a simple manner, at least simpler than with railroad ties with a completely flat underside. In the case of bridges, levelling railroad ties is often necessary as the bridge ties are virtually never at the same height, so that the railroad tie must be leveled to size at the underside. Also, when the track negotiates a bend on a bridge while the outer rail is to be higher than the inner one, levelling is often required.

Figures 8A, 8B:
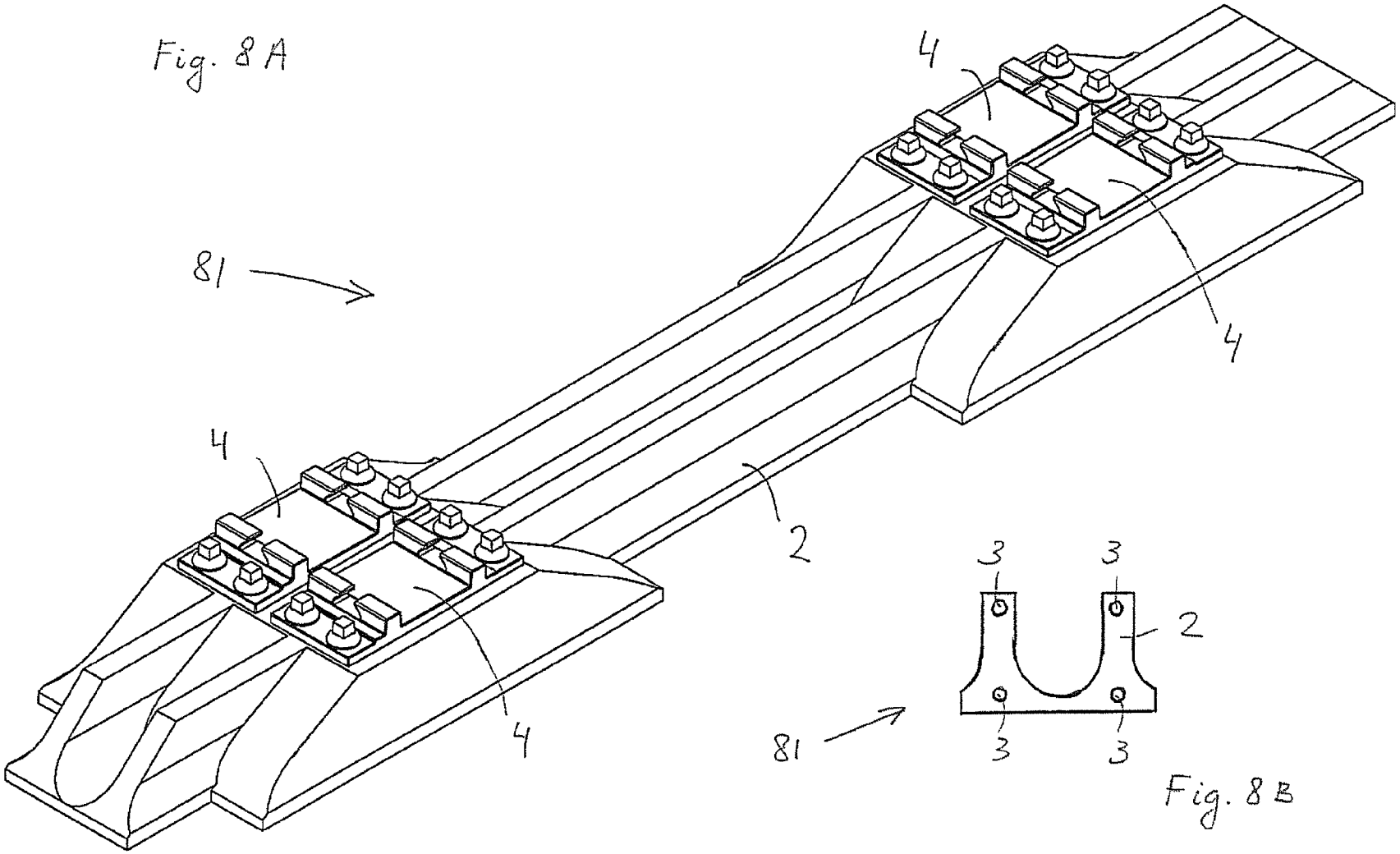
FIG. 8A shows, in perspective, an example of yet a further embodiment of a railroad tie according to the invention.
FIG. 8B shows a cross section of the railroad tie shown in FIG. 8A at the location of the center of the length of the railroad tie.

In a railroad, railroad ties are also used at those locations where two pairs of rails meet, but are not been welded together. Here, the rails of the two rail pairs are coupled to each other by means of electrically insulated connecting elements. This is done for electrically separating the different rail parts, which, in turn, is used for observing the location of a train by means of electric signals. As these rails are not welded together, the ends of these rails exert great local forces on the underlying railroad tie. Concrete can withstand these local forces very poorly. Consequently, at these locations, often, two coupled together wooden railroad ties are used. In plastic, it is possible to produce a railroad tie with this functionality from one piece. To that end, for instance, a railroad tie 81 as shown in FIGS. 8A and 8B can be utilized. The railroad tie 81 shown has four instead of only two tie plates. Therefore, a preferred embodiment of a method for building or adapting a railroad is characterized in that at least at one location in the railroad where a first rail pair of two parallel side-by-side rails in a railroad longitudinal direction links up with a second, similar rail pair in a manner such that the first and the second rail pair are electrically separated from each other, one specimen of the railroad tie according to the invention is utilized such that the ends of the rails of the first and of the second rail pair linking up with each other are each connected to said one specimen of the railroad tie.

The invention claimed is:

1. A railroad tie manufactured from plastic (2), and further comprising at least two steel bars (3) embedded in the plastic, wherein the steel bars extend in longitudinal direction of the plastic railroad tie (1; 41; 51; 61; 71; 81) and wherein the bars (3) are situated, in operative condition, at different heights in the railroad tie and are free from mutual connections other than by the plastic, wherein all of the plastic in the railroad tie consists of low density polyethylene.

2. A railroad tie according to claim 1, wherein at least one of the at least two bars (3) extends in a first zone (I) of the railroad tie, which first zone is located in operative condition between a longitudinal side of the railroad tie and a sectional plane through the railroad tie located at a first distance from the longitudinal side, and wherein at least one other of the at least two bars (3) extends in a similar first zone (I) located opposite the first zone at the opposite longitudinal side, and wherein the first distance is less than 25% of the width of the railroad tie.

3. A railroad tie according to claim 2, wherein at least one of the at least two bars (3) extends in a second zone (II) of the railroad tie, which second zone is located in operative condition between a top, or bottom, of the railroad tie and a sectional plane through the railroad tie, located at a second distance from the top, or bottom, and wherein at least one other of the at least two bars (3) extends in a similar second zone (II) located opposite the second zone at the opposite top, or bottom, and wherein the second distance is less than 25% of the width of the railroad tie, and wherein four respective specimens of the at least two bars (3) are located in four different areas, respectively, each of which being an overlapping area of one of the first zones (I) and one of the second zones (II).

4. A railroad tie according to claim 2, wherein the first distance is less than 15% of the width of the railroad tie.

5. A railroad tie according to claim 1, wherein at least one of the at least two bars (3) extends in a second zone (II) of the railroad tie, which second zone is located in operative condition between a top, or bottom, of the railroad tie and a sectional plane through the railroad tie, located at a second distance from the top, or bottom, and wherein at least one other of the at least two bars (3) extends in a similar second zone (II) located opposite the second zone at the opposite top, or bottom, and wherein the second distance is less than 25% of the width of the railroad tie.

6. A railroad tie according to claim 5, wherein the second distance is less than 15% of the width of the railroad tie.

7. A railroad tie according to claim 1, wherein the railroad tie comprises one or more recesses for receiving attachment means for attaching railroad rails to the railroad tie.

8. A railroad tie according to claim 1, wherein at least one of the at least two steel bars (3) has a non-smooth surface.

9. A railroad tie according to claim 1, wherein ends of the at least two steel bars (3) are in the railroad tie at a distance from ends of the railroad tie.

10. A railroad tie according to claim 1, wherein, in operative condition, a top of the railroad tie (41; 51; 61; 81) comprises at least one recessed top area which is recessed with respect to two spaced apart rail attachment areas of this top.

11. A railroad tie according to claim 10, wherein the entire portion of the top of the railroad tie (51) located outside the two rail attachment areas is recessed relative to the rail attachment areas.

12. A railroad tie according to claim 1, wherein, in operative condition, a bottom and/or sides of the railroad tie (61) are profiled.

13. A railroad tie according to claim 1, wherein in two spaced apart respective rail supporting longitudinal segments in the longitudinal direction of the railroad tie, the railroad tie (71) has a greater height than in other longitudinal segments in the longitudinal direction of the railroad tie located outside these rail supporting longitudinal segments, in a manner such that an underside of the railroad tie (7), in operative condition, in the longitudinal direction of these two respective rail supporting longitudinal segments, is located lower than in the longitudinal direction of the other longitudinal segments.

14. A method for building or adapting a railroad, wherein a railroad tie (1; 41; 51; 61; 71; 81) according to claim 1 is utilized in the railroad.

15. A method according to claim 14, wherein an existing railroad tie present in the railroad is replaced by the railroad tie (1; 41; 51; 61; 71; 81).

16. A method according to claim 14, wherein during building or adapting of the railroad, drilling is carried out in situ in the railroad tie (1; 41; 51; 61; 71; 81) for attaching rails to the railroad tie.

17. A method according to claim 14, wherein the railroad tie (1; 41; 51; 61; 71; 81) is utilized on a railroad bridge.

18. A method according to claim 14, wherein the railroad tie (1; 41; 51; 61; 71; 81) is utilized in a railroad switch.

19. A method according to claim 14, wherein at at least one location in the railroad where a first rail pair of two parallel, side-by-side rails links up in railroad longitudinal direction with a second similar rail pair in a manner such that the first and the second rail pair are electrically separated from each other, one specimen of the railroad tie (81) is used such that the ends of the rails of the first and of the second rail pair linking up with each other are each attached to said one specimen of the railroad tie (81).

* * * * *